US006724157B2

(12) United States Patent
Kazanov et al.

(10) Patent No.: US 6,724,157 B2
(45) Date of Patent: Apr. 20, 2004

(54) ENERGY SAVINGS DEVICE AND METHOD FOR A RESISTIVE AND/OR AN INDUCTIVE LOAD

(75) Inventors: Anatoly L. Kazanov, Reisterstown, MD (US); Mark E. Hall, Bowie, MD (US); Anthony Paige, Fort Washington, MD (US)

(73) Assignee: Astral Communications Inc., Fort Washington, MD (US)

( * ) Notice: Subject to any disclaimer, the term of this patent is extended or adjusted under 35 U.S.C. 154(b) by 0 days.

(21) Appl. No.: 10/205,031

(22) Filed: Jul. 26, 2002

(65) Prior Publication Data

US 2003/0090219 A1 May 15, 2003

Related U.S. Application Data

(60) Provisional application No. 60/336,222, filed on Nov. 14, 2001.

(51) Int. Cl.[7] ..... G05F 1/00

(52) U.S. Cl. ..... 315/291; 315/194; 315/307

(58) Field of Search ..... 315/291, 158, 315/307, 297, 194, 315, 360, 209 R, 219, 362; 323/243, 322

(56) References Cited

U.S. PATENT DOCUMENTS

| | | | | |
|---|---|---|---|---|
| 4,287,468 A | | 9/1981 | Sherman | 323/322 |
| 4,346,331 A | | 8/1982 | Hoge | 315/158 |
| 4,350,935 A | | 9/1982 | Spira et al. | 315/291 |
| 4,379,254 A | | 4/1983 | Hurban | 315/291 |
| 4,527,099 A | | 7/1985 | Capewell et al. | 315/291 |
| 4,558,262 A | | 12/1985 | Longenderfer et al. | 315/307 |
| 4,800,330 A | | 1/1989 | Pelonis | 323/243 |
| 4,937,504 A | | 6/1990 | Black, Jr. et al. | 315/307 |
| 4,949,020 A | | 8/1990 | Warren et al. | 315/297 |
| 4,954,768 A | | 9/1990 | Luchaco et al. | 323/300 |
| 5,043,635 A | | 8/1991 | Talbott et al. | 315/291 |
| 5,055,742 A | | 10/1991 | Jurell et al. | 315/94 |
| 5,077,512 A | * | 12/1991 | Weber | 318/776 |
| 5,144,205 A | | 9/1992 | Motto et al. | 315/244 |
| 5,729,097 A | | 3/1998 | Holzer | 315/307 |
| 5,841,239 A | | 11/1998 | Sullivan et al. | 315/291 |
| 6,091,205 A | | 7/2000 | Newman, Jr. et al. | 315/194 |
| 6,100,642 A | * | 8/2000 | Kim | 315/205 |
| 6,181,072 B1 | | 1/2001 | Leslie et al. | 315/194 |
| 6,225,760 B1 | | 5/2001 | Moan | 315/360 |
| 6,380,692 B1 | | 4/2002 | Newman, Jr. et al. | 315/194 |

* cited by examiner

*Primary Examiner*—James Clinger
(74) *Attorney, Agent, or Firm*—Foley & Lardner

(57) ABSTRACT

An energy savings device for an inductive or resistive load, such as a fluorescent light fixture having a magnetic ballast, which is powered by an AC voltage waveform. The energy savings devices includes a setting unit for setting a desired power operating level for the load. The energy savings device also includes a microprocessor configured to receive a signal from the setting unit indicative of the desired power operating level for the load, to determine a phase delay to be provided to an output AC voltage waveform that is to be provided to the load, and to output a control signal as a result thereof. The energy savings device further includes an active element provided between a line that provides the input AC voltage waveform and the load, the active element receiving the control signal and turning off and on at predetermined times in accordance with the control signal, so as to create the output AC voltage waveform from the AC voltage waveform.

22 Claims, 10 Drawing Sheets

UCD Block Diagram

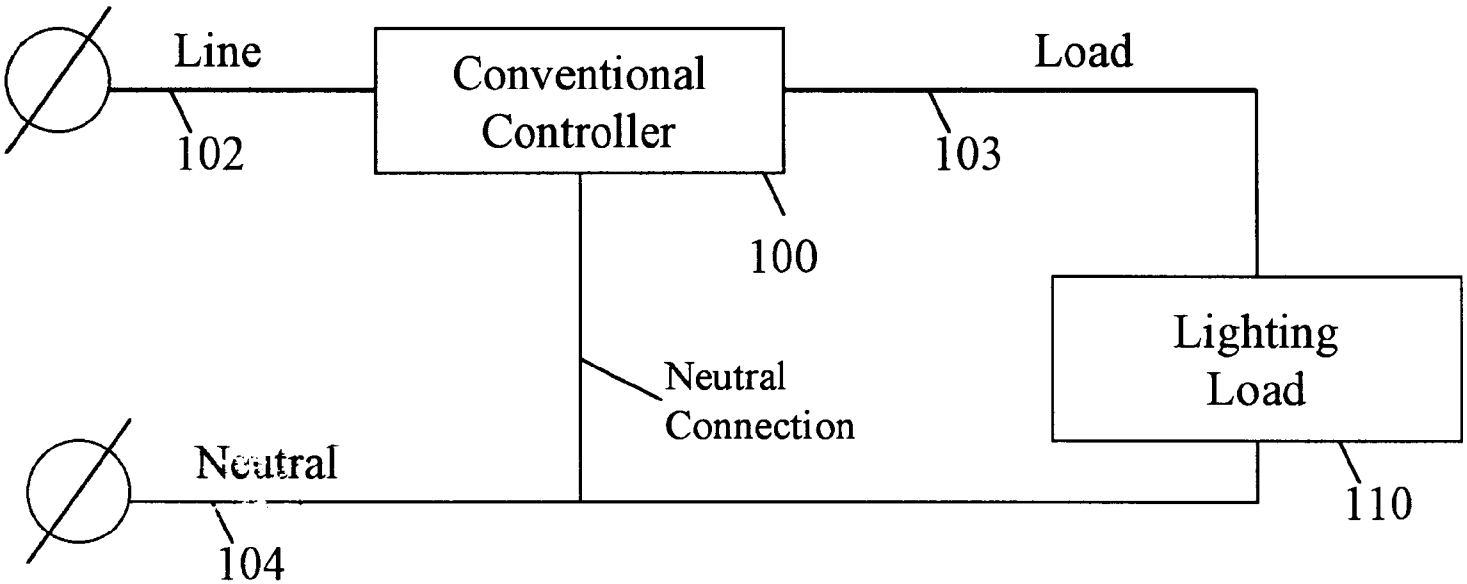
Figure 1A: Prior Art

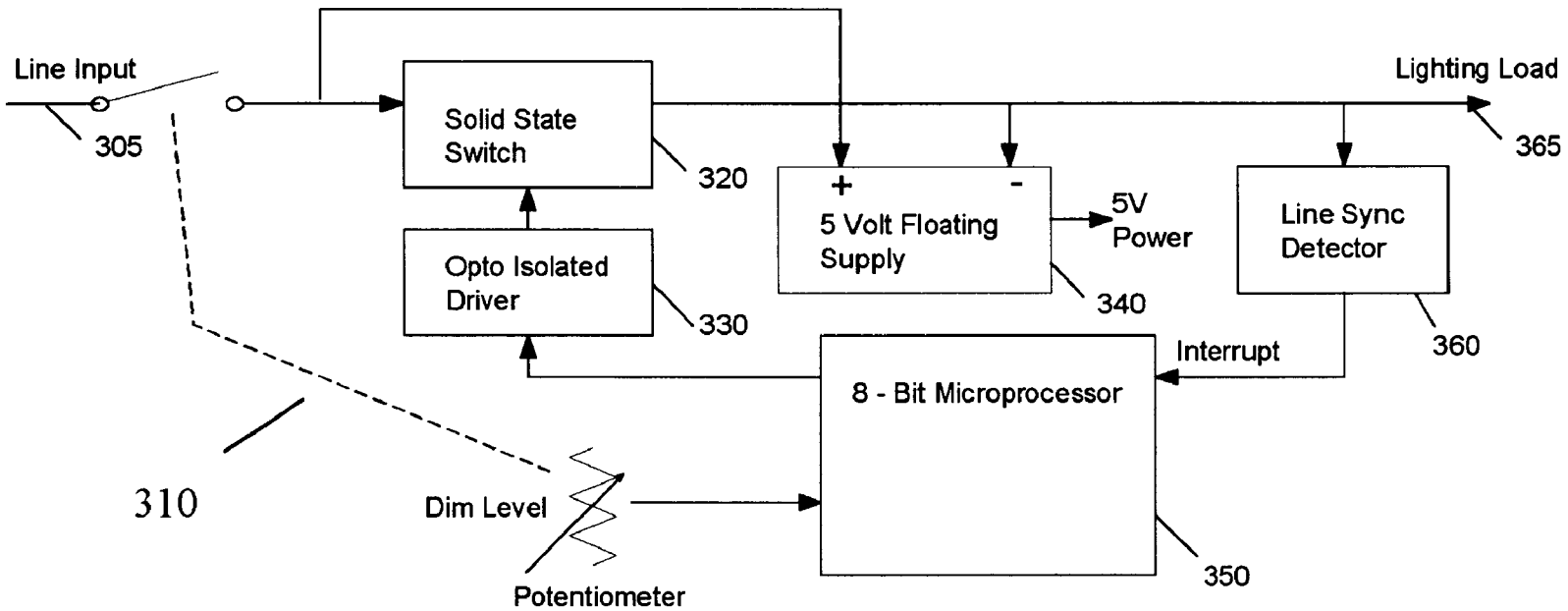
Figure 3: UCD Block Diagram

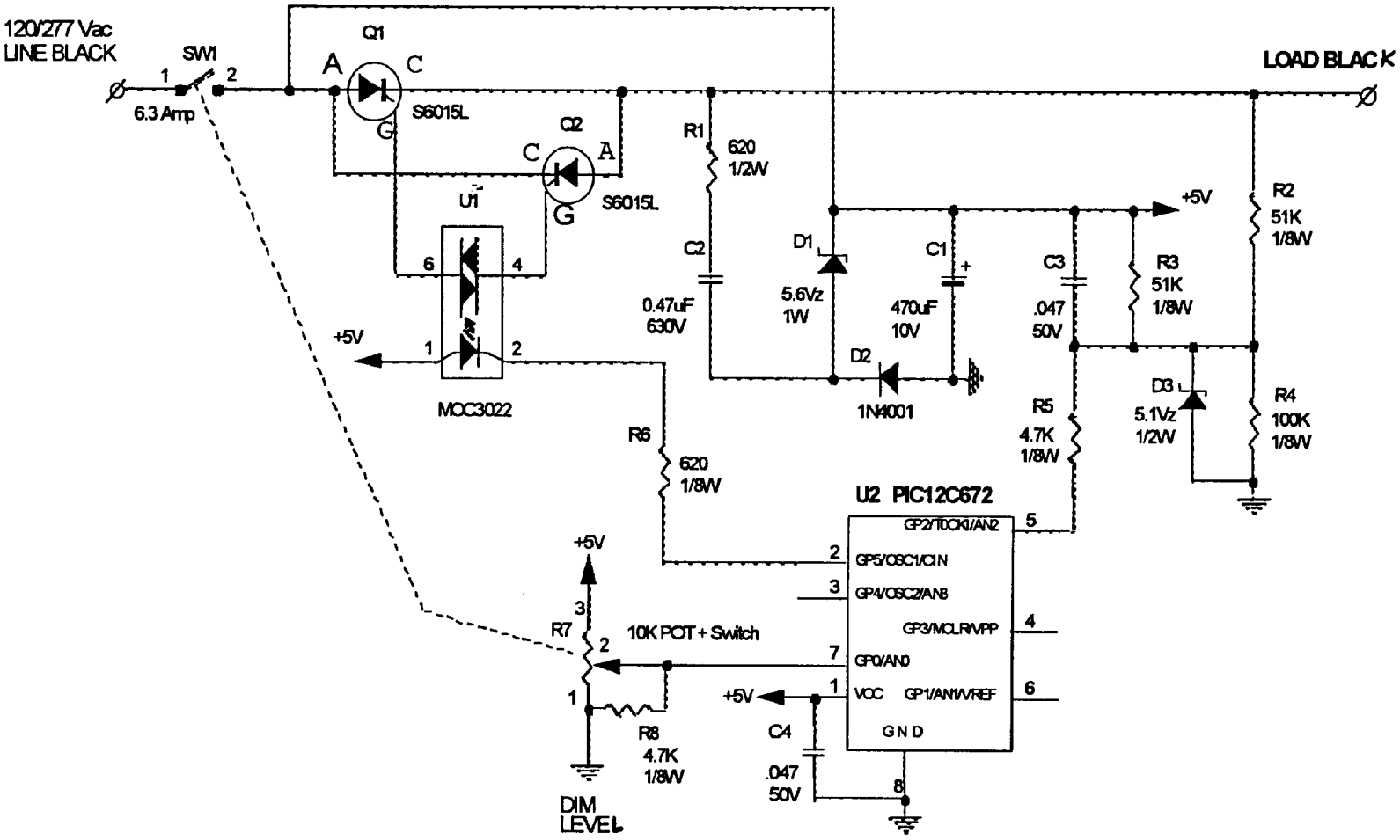
FIGURE 4: UCD Schematic Diagram

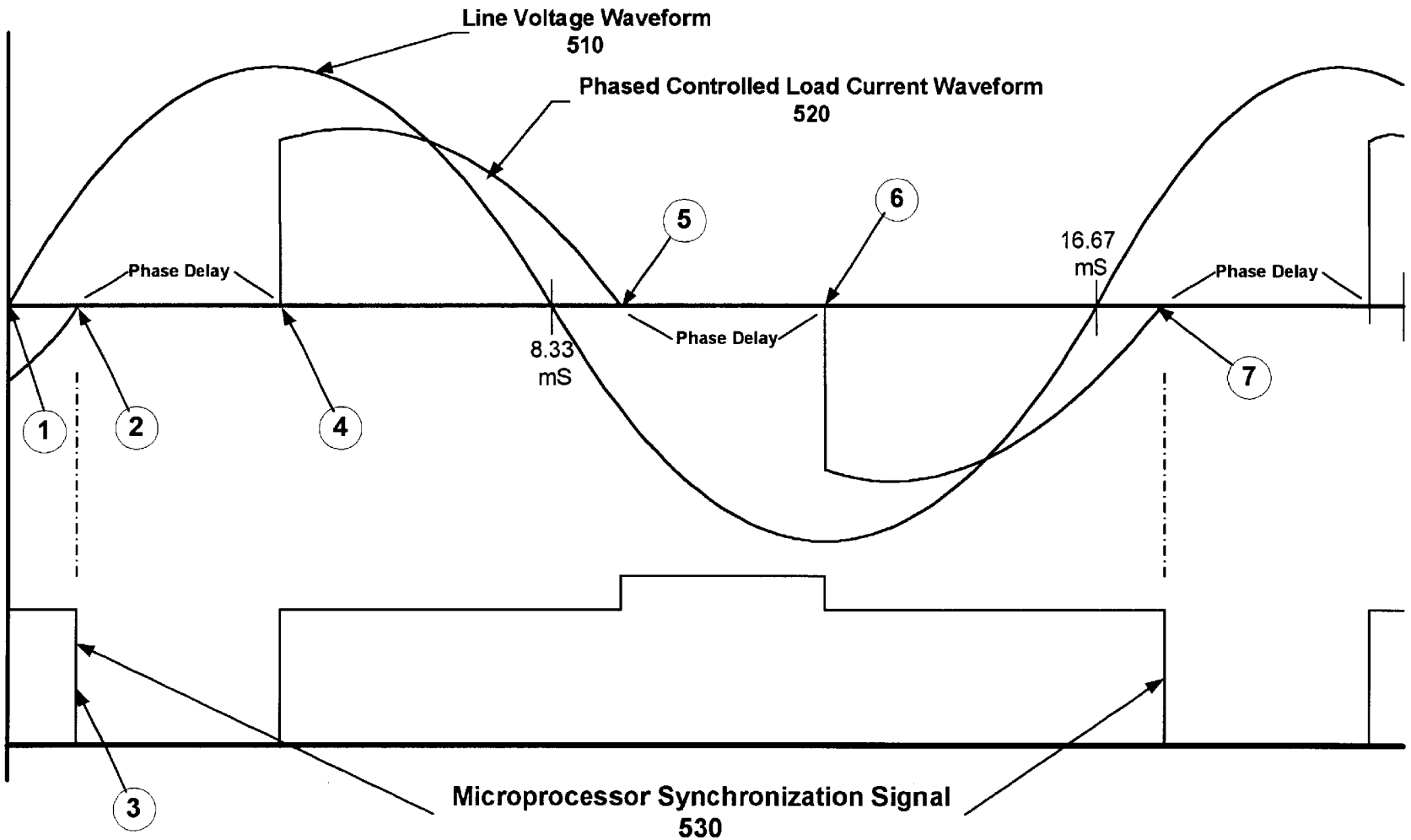
Figure 5: Phase Control Waveforms

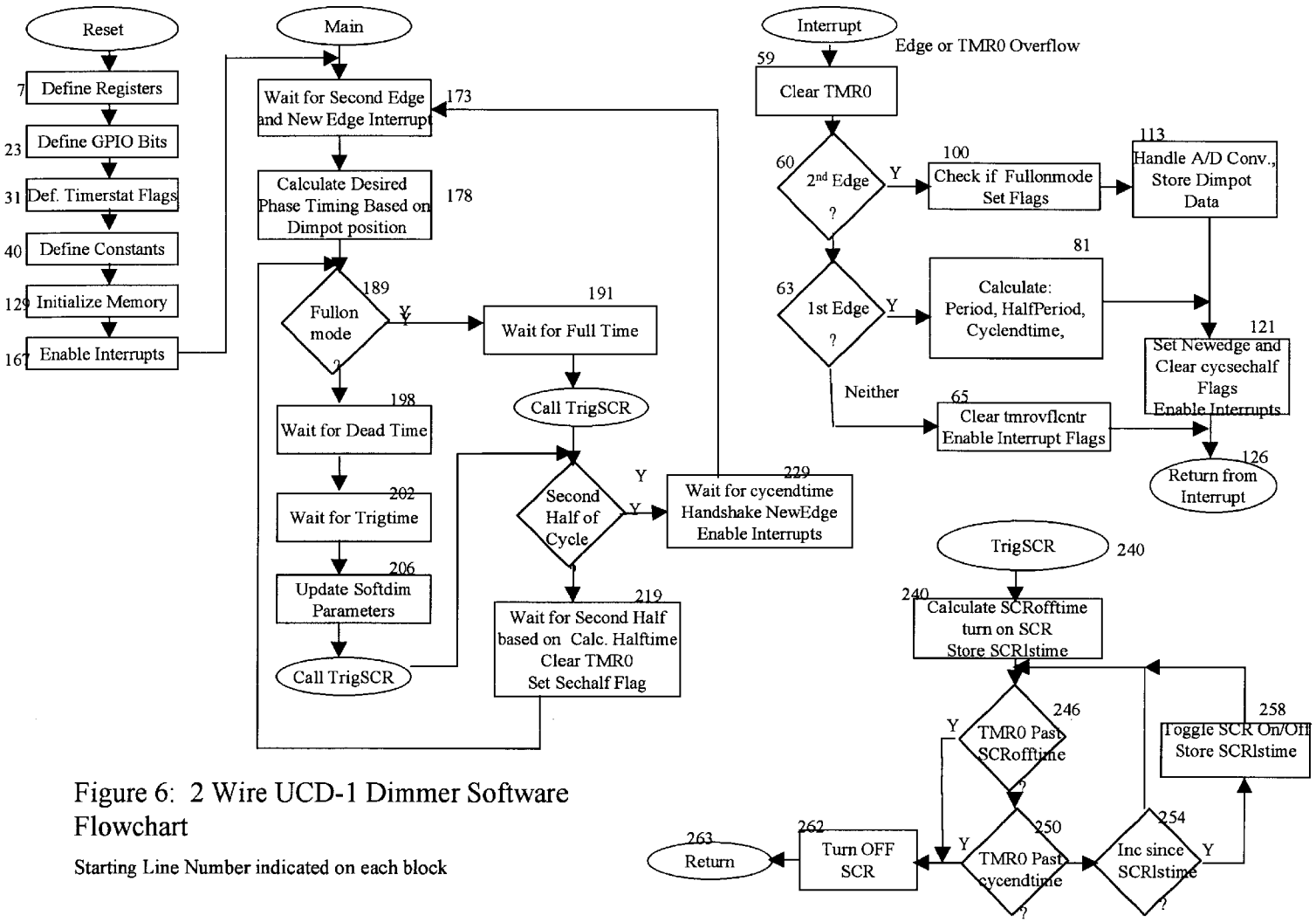
Figure 6: 2 Wire UCD-1 Dimmer Software Flowchart
Starting Line Number indicated on each block

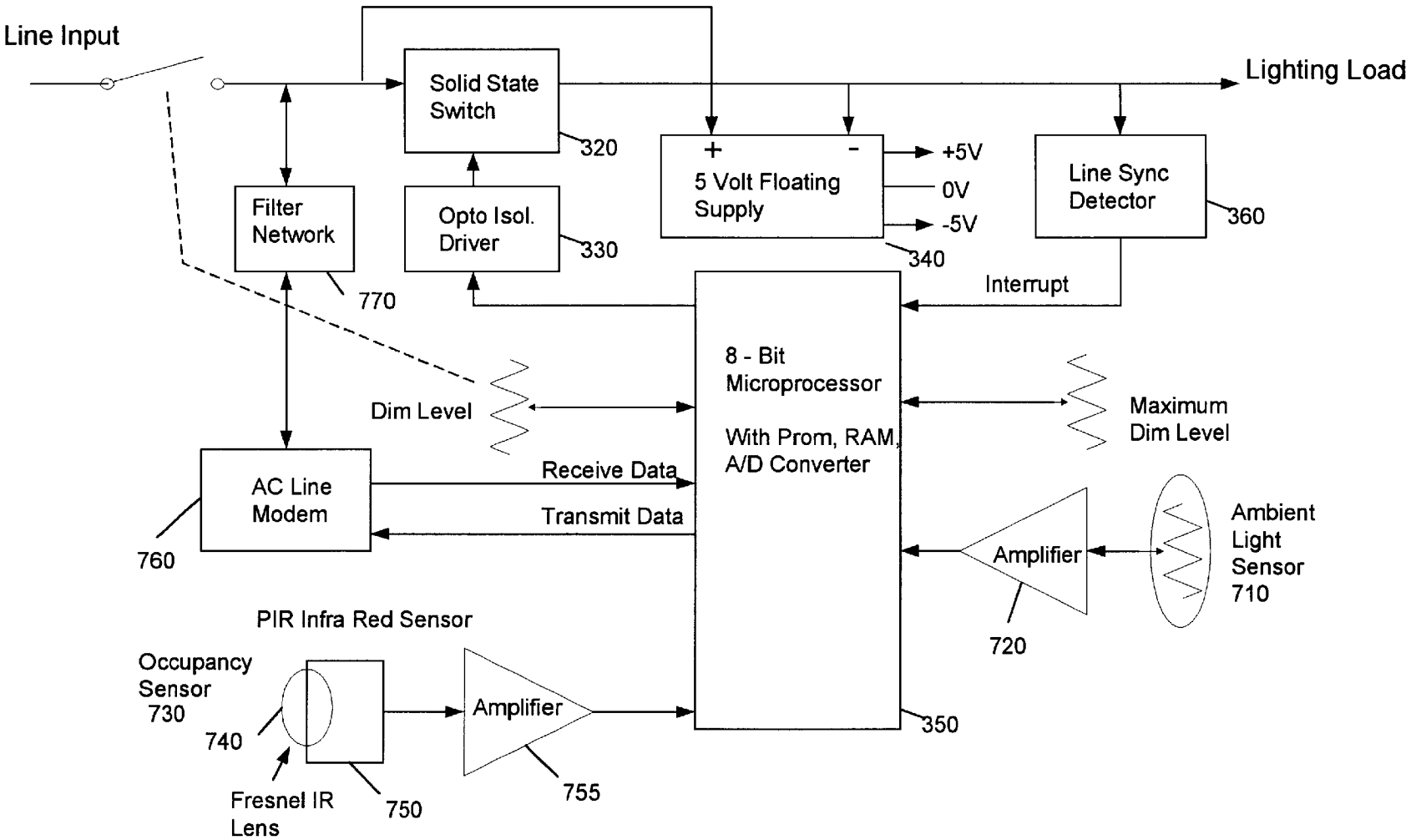
Figure 7: UCD-2 Block Diagram

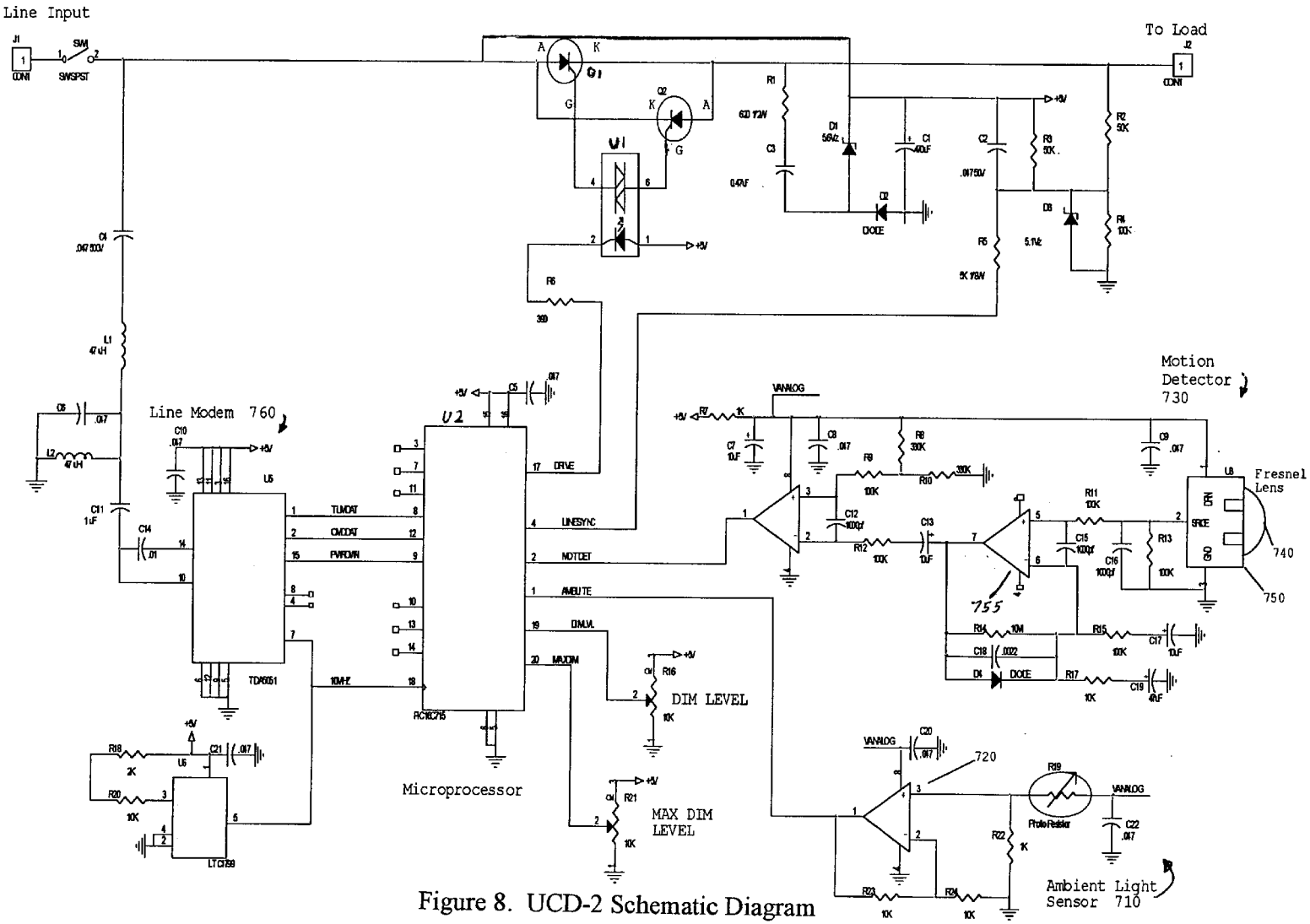
Figure 8. UCD-2 Schematic Diagram

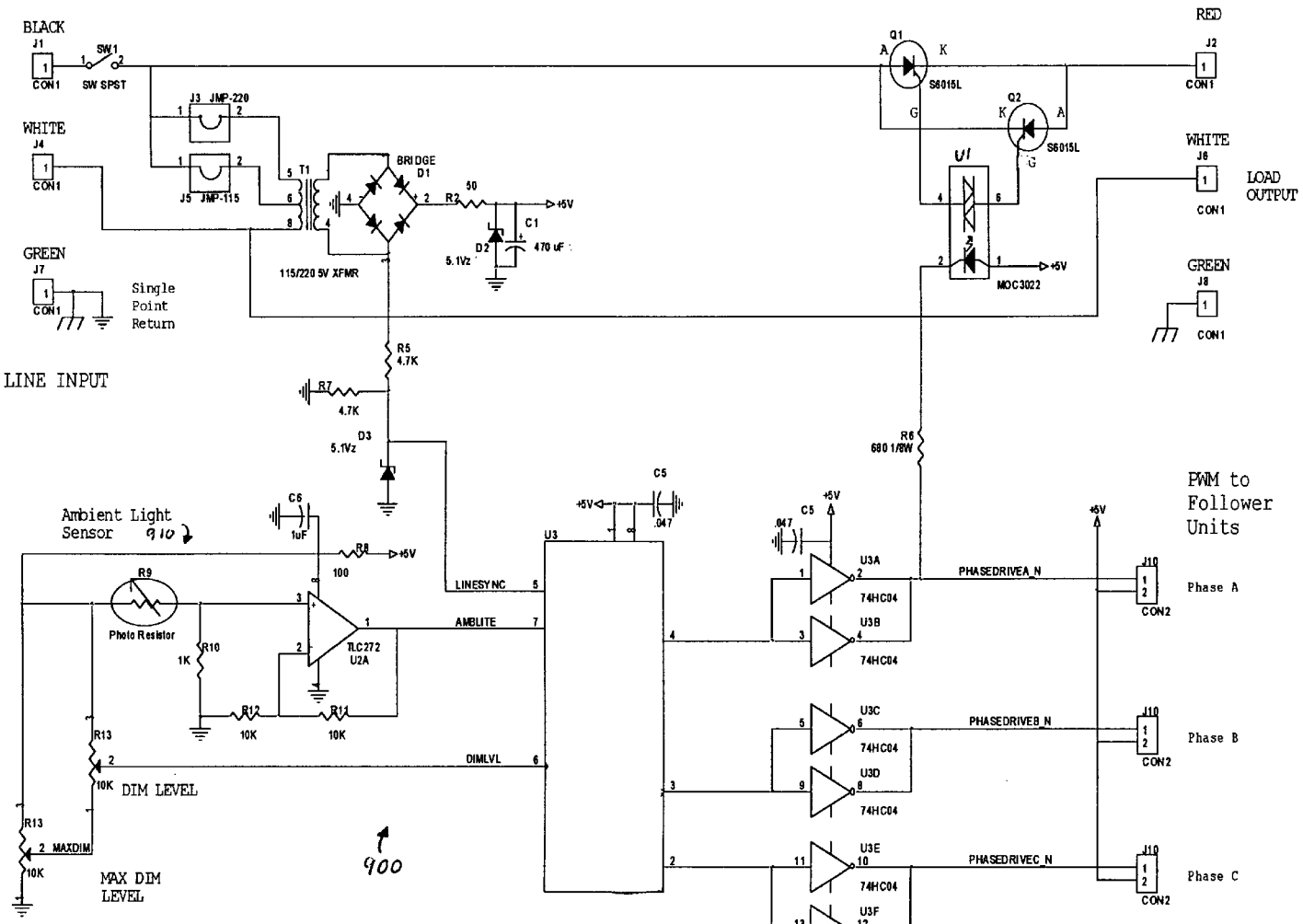
Figure 9. Master Unit

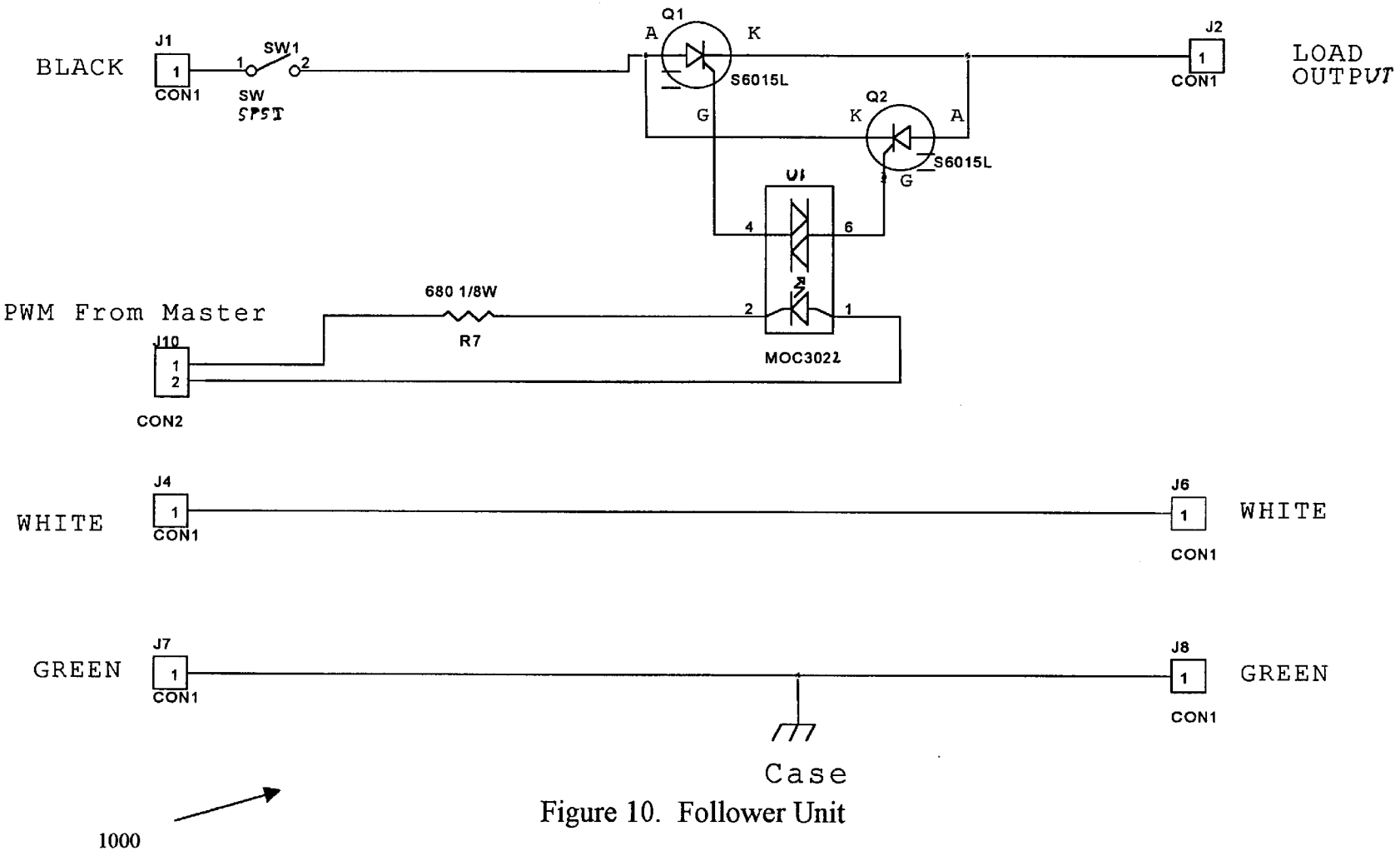
Figure 10. Follower Unit

ENERGY SAVINGS DEVICE AND METHOD FOR A RESISTIVE AND/OR AN INDUCTIVE LOAD

BACKGROUND OF THE INVENTION

A. Field of the Invention

The invention relates to an energy savings device or method that can be applied to a resistive or an inductive load regardless of the impedance or inductance of the load. More particularly, the invention relates to a reactive load dimming device that is mounted in series with a resistive or an inductive load and that has access for power and operation to one side of an electrical line supplied to the load. A fluorescent light fixture or a motor for a fan or other device, for example, can be controlled by way of an energy savings device or method according to the invention.

B. Description of the Related Art

The ability to control illumination levels is strongly desired, especially due to the rising energy costs. Such ability to control illumination levels is very important for establishments that require a great deal of lighting, such as restaurants and offices.

Lighting levels that are higher than necessary not only result in a higher energy costs associated with the lighting, but also can increase air conditioning costs due to the excess heat provided by the lighting fixtures. Fluorescent light fixtures output less heat than incandescent light fixtures for equivalent illumination, and thus they are becoming more popular with offices or other commercial establishments.

There currently exist various types of dimmer devices that can be used in order to control the amount of light output by fluorescent lights. One type utilizes a complex electronic ballast which first converts the applied AC line voltage to DC, then switches the applied tube voltage at high frequency. The resulting power-to-light output efficiency is hampered by this additional manipulation. This type requires an expensive fixture replacement and rewiring to the wall switch. Simplistic phase control devices will not provide satisfactory results when controlling a magnetic ballast fluorescent fixture.

FIG. 1A shows the connections of a conventional fluorescent dimmer device or controller 100, which is provided between a line and a load. The load is shown as a light fixture 110, which may be a fluorescent tube and associated ballast, for example. As shown in FIG. 1A, the conventional controller 100 needs access to both sides (line 102 and neutral 104) of an AC power input, in addition to the load. Since connectivity to the neutral line 104 is not always available at a light switch box, conventional fluorescent controllers may require expensive re-wiring to be installed.

The problem with using such a conventional dimmer circuit for a fluorescent lighting fixture is that the conventional dimmer circuit cannot modulate reactive loads. Reactive loads react with the controller, thereby producing oscillations that then cause surges of voltage and current, which are both unpredictable and uncontrollable. With such control being applied to a fluorescent light fixture, the typical result is a non-harmonic type of flickering, which frequently takes the light from zero output to maximum output and to values in between. Such flickering is visually (and also audibly) discomforting, and may even be unhealthful to people who are near the flickering fluorescent light (for example, it may cause headaches due to having to view the undesirable light flickering).

As explained earlier, a controller such as the one shown in FIG. 1A can be used to control a fluorescent light without causing significant flickering, but such a controller requires fairly substantial installation costs, since they cannot be installed at a light switch box (where a neutral line is not typically provided), but rather have to be installed very close to the ballast (e.g., in the ceiling of a room, where a neutral line is provided).

U.S. Pat. No. 5,043,635 to Talbott et al. describes a two-line power control device for dimming fluorescent lights, which does not require to be coupled to a neutral line. Accordingly, the Talbott et al. device can in theory be installed at a light switch box. However, due to the analog structure and the various components described in the Talbott et al. device, such a device is very difficult to manufacture, and also such a device is very difficult to manufacture in a small size. Thus, it is not feasible to install such a device in a light switch box, given the bulkiness as well as the transformer configuration of the Talbott et al. device.

SUMMARY OF THE INVENTION

The present invention is directed to an apparatus and a method for controlling an amount of power supplied to a resistive or inductive load by modulating a period of time that current flows through the load.

According to one aspect of the invention, there is provided an energy savings device for an inductive or resistive load that is powered by an input AC voltage waveform. The device includes a setting unit for setting a desired power operating level for the load. The device also includes a microprocessor configured to receive a signal from the setting unit indicative of the desired power operating level for the load, to determine a phase delay to be provided to an output AC voltage waveform that is to be provided to the load, and to output a control signal as a result thereof. The device further includes an active element provided between a line that provides the input AC voltage waveform and the load, the active element receiving the control signal and turning off and on at predetermined times in accordance with the control signal, so as to create the output AC voltage waveform from the input AC voltage waveform.

According to another aspect of the invention, there is provided an energy savings method for an inductive or resistive load that is powered by an input AC voltage waveform. The method includes setting a desired power operating level for the load. The method further includes receiving a signal indicative of the desired power operating level for the load, and determining a phase delay to be provided to an output AC voltage waveform that is to be provided to the load, and to output a control signal as a result thereof. The method also includes receiving the control signal, and, in response thereto, turning an active element off and on at predetermined times in accordance with the control signal, so as to create the output AC voltage waveform from the input AC voltage waveform. The active element is disposed between a line carrying the input AC voltage waveform and the load.

According to yet another aspect of the invention, there is provided a computer program product for providing energy savings for an inductive or resistive load that is powered by an input AC voltage waveform. The computer program product includes first computer code configured to set a desired power operating level for the load. The computer program product also includes second computer code configured to receive a setting signal output from the first computer code that is indicative of the desired power operating level for the load, the second computer code further configured to determine a phase delay to be provided to an output AC voltage waveform that is to be provided to the load, and to output a control signal as a result thereof. The computer program product further includes third computer code configured to provide a control signal to an active element provided between a line that provides the input AC voltage waveform and the load, the active element receiving the control signal and turning off and on at predetermined times in accordance with the control signal, so as to create the output AC voltage waveform from the input AC voltage waveform. The control signal is provided based on the phase delay determined by the second computer code and the setting signal output by the first computer code.

According to yet another aspect of the invention, there is provided an energy savings device for an inductive or resistive load that is powered by an input AC voltage waveform. The energy savings device includes setting means for allowing a user to set a desired power operating level for the load. The energy savings device also includes processing means for receiving a signal from the setting unit indicative of the desired power operating level for the load, and for determining a phase delay to be provided to an output AC voltage waveform that is to be provided to the load, and to output a control signal as a result thereof. The energy savings device further includes signal conversion means, provided between a line that provides the input AC voltage waveform and the load, for receiving the control signal and turning off and on at predetermined times in accordance with the control signal, so as to create the output AC voltage waveform from the input AC voltage waveform.

BRIEF DESCRIPTION OF THE DRAWINGS

The foregoing advantages and features of the invention will become apparent upon reference to the following detailed description and the accompanying drawings, of which:

FIG. 1A shows a hookup of a conventional energy savings device that is provided between an input voltage line and a load;

FIG. 3 is a block diagram of an energy savings device according to a first embodiment of the invention;

FIG. 4 is a schematic circuit diagram of an energy savings device according to the first embodiment of the invention;

FIG. 5 shows phase control waveforms according to the first embodiment of the invention;

FIG. 6 is a software flow diagram of microprocessor firmware that operates according to the first embodiment of the invention;

FIG. 7 is a block diagram of an energy savings device according to a second embodiment of the invention;

FIG. 8 is a schematic circuit diagram of an energy savings device according to the second embodiment of the invention;

FIG. 9 is a schematic circuit diagram of a master unit according to a seventh embodiment of the invention; and FIG. 10 is a schematic circuit diagram of a follower unit according to the seventh embodiment of the invention.

DETAILED DESCRIPTION OF THE INVENTION

Preferred embodiments of the invention will be described in detail below, with reference to the accompanying drawings.

Figure 1B:
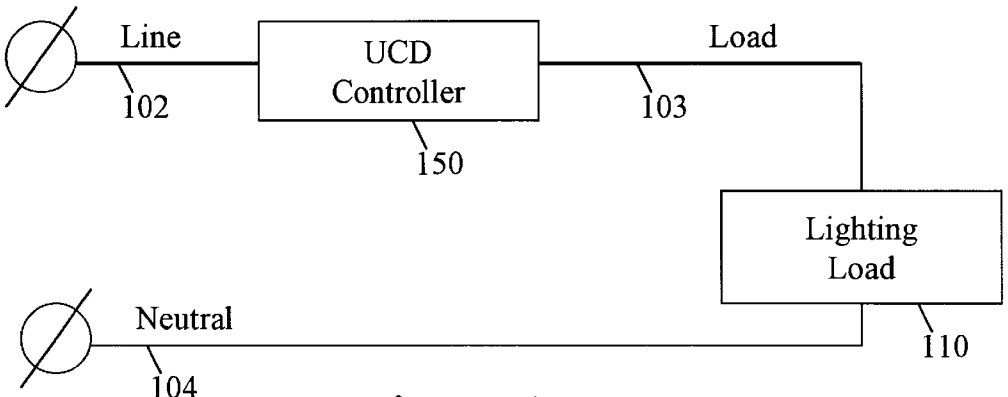
FIG. 1B shows a hookup of an energy savings device according to an embodiment of the invention that is provided between an input voltage line and a load.

The invention is directed to an apparatus and method for controlling power to a resistive or inductive load, such as a fluorescent light fixture, a halogen light fixture, or a motor for a fan. In a preferred configuration, the energy controlling apparatus is configured to be installed in a light switch box typically located on an interior wall of a building, behind a wall switch plate. Since most light switches are mounted within a switch box that is easily accessible through the wall (e.g., behind a switch plate), the line to the switch is dropped from the fixture to the switch, and the other side of the line (e.g., neutral) is not conveniently present. The invention provides a true switch replacement and operates in series with an inductive or resistive load, in a two-wire configuration, plus safety ground wire. FIG. 1B shows a hookup of an energy savings device 150 according to an embodiment of the invention that is provided between the input AC line voltage 102 and a reactive load 110, whereby hookup to the neutral line 104 is not required by the energy savings device 150 in order to provide an energy control function for the load 110.

Figure 2:
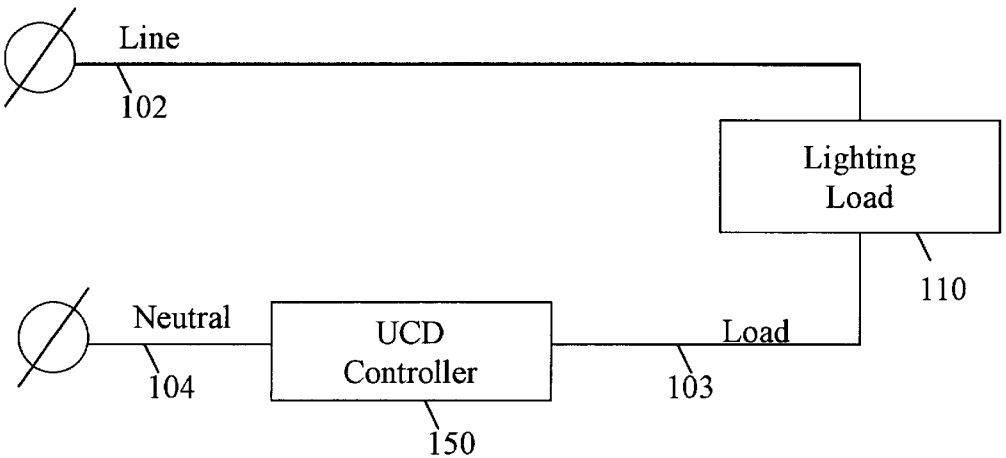
FIG. 2 shows an alternative hookup of an energy savings device according to an embodiment of the invention that provides neutral side control.

Additionally, referring now to FIG. 2, some installations will wire the line 102 directly to the light fixture 110, leaving the load return 103 for fixture control. In this case, there is no line 102 connection in the switch box, again disallowing integration of a conventional fluorescent dimmer device. The UCD controller 150 is fully compatible with neutral 104 side control, in the manner as shown in FIG. 2. In summary, the UCD controller according to the different embodiments of the invention is installed in series with the load, on either side of the load, without regard to wiring polarity, identically to a dry contact switch installation.

With regards to fluorescent light fixtures, the energy savings device according to the invention regulates a voltage output to gaseous discharge lamps of the fluorescent light fixture from the secondary coils of a ballast element of the fluorescent light fixture.

A universal control device (or UCD) according to a first embodiment of the invention will be described below in detail. A block diagram of the UCD according to the first embodiment is shown in FIG. 3, and a schematic circuit diagram of the UCD according to the first embodiment is shown in FIG. 4.

The UCD according to the first embodiment includes a "push" On/Off switch and potentiometer unit 310 that is coupled to a line input (AC input voltage) 305, a solid state switch unit 320, a driver 330 for driving the solid state switch unit 320, a power supply 340, a microprocessor 350, and a line synchronization detector 360. The solid state switch unit 320 is provided between the line input 305 and the load 365. The switch and potentiometer unit 310 includes a "push" On/Off switch SW1 and a potentiometer POT. The line synchronization detector 360 provides an interrupt signal to the microprocessor 350, which corresponds to "rising" zero crossing of a load current waveform, to be explained in more detail below.

The UCD is a two wire dimmer unit, and can be utilized to control standard magnetic ballast fluorescent fixtures. Of course, the UCD may be used to control other resistive or inductive loads. The UCD functions similar to incandescent dimmers, but it also implements line synchronization functions and timing functions (not done by incandescent dimmers) to allow it to control fluorescent fixtures and/or other types of reactive loads. In a preferred configuration, the UCD is wired in series with the fluorescent load without observance of wiring polarity, in either the hot or return side of the load, in a manner that is identical to a standard single pole wall switch. In fact, the UCD is configured so as to replace any existing wall switch to provide a dimming functionality.

In a preferred implementation of the first embodiment, the UCD implements an 8-bit digital microprocessor 350 (of course, other types of microprocessors, such as 16-bit, 32-bit, etc., may be utilized instead of an 8-bit microprocessor, while remaining within the scope of the invention) with embedded firmware control algorithms for minimum parts count, and highly stable operation. The UCD according to the first embodiment is compatible with any configuration of magnetic ballast fluorescent and/or incandescent loads. In a preferred construction, unit size, costs, producibility, performance and stability are optimized through the use of advanced digital and mass production techniques. Other embodiments to be described later include occupancy sensing, ambient light correction, and AC line modem for communication with a remote Energy Management System. All of the embodiments to be described herein are "in series", two wire devices (see FIG. 1B or FIG. 2).

Table 1 provides line specifications of the UCD according to a preferred implementation of the first embodiment of the invention. One of ordinary skill in the art will recognize that other line specification ranges may be handled by the UCD according to the first embodiment, while remaining within the scope of the invention.

TABLE 1

| Line Specifications | | |
|---|---|---|
| Voltage | 110/277 | Vac |
| Frequency | 50/60 | Hz |
| Load Current | 6.3 | Amps Maximum |
| Load/Watts | 750 | Watts Maximum |
| Power Factor | 0.87–0.90 | (full power) |
| THD | <35% | (full power) |
| EMI/RFI | FCC | Part 18 |

The UCD according to the first embodiment provides AC line synchronization and timing firmware algorithms used to provide stable dimming control of an inductive and/or resistive load without regard to applied line voltage, frequency, and without requiring a specific connection to the AC Line Return or Safety Ground. The UCD according to the first embodiment implements phase control of the load, and also strategically controls the switching element turn-on timing for stable (non-flickering) control of inductive or resistive loads. The UCD according to the first embodiment synchronizes on the load current zero crossing, which causes a turning off of the series switching elements making up the solid state switch unit 320.

Highly inductive or resistive loads, such as magnetic fluorescent ballasts, cause a significant phase shift (delay) of the load current waveform relative to the applied voltage waveform, greatly complicating stable synchronization. This phase shift varies depending on the specific installation (number of fixtures and specific ballast specifications) as well as the selected dimming level. As the dimming level is varied, or fluorescent tube temperature changes, the current zero crossing synchronization signal to the microprocessor will move significantly in real time, causing a shift in phase timing for the next cycle. Unless a suitable phase timing algorithm is implemented, the light fixture will flicker in an oscillatory way, resulting in unstable (highly unsatisfactory) dimming. The inventors of this application realized that standard incandescent dimmers will not reliably function with fluorescent or other types of reactive loads due to their simplistic line synchronization methods. The timing correction algorithms utilized in the present invention are an important aspect of the UCD design according to the first embodiment (as well as to the other embodiments), and are described in detail below.

FIG. 5 shows the applied line voltage waveform, the dimmed fluorescent load current waveform, and the microprocessor synchronization waveform as implemented by the UCD according to the first embodiment. Also shown in FIG. 5 are seven (7) time points in a single cycle of the applied line voltage waveform (60 Hz or 16.67 msec time period for one cycle), each of which is discussed in detail below. The highly inductive nature of a fluorescent magnetic ballast causes the load current to lag the applied line voltage, as seen in the comparison of the AC line voltage waveform 510 with the load current waveform 520. The amount of lag depends on the circuit inductance, specific ballast design factors, tube striking voltage which is affected by tube temperature, and the amount of dimming phase delay being applied by the UCD according to the first embodiment. A point by point discussion of the seven labeled time points in FIG. 5 follows, with reference to the circuit elements shown in FIG. 4.

Time point 1 corresponds to the rising zero crossing of the applied line voltage waveform 510.

Time point 2 corresponds to the turn off point of Silicon Controlled Rectifier (SCR) Q2 from the previous dim cycle. An SCR turns off when the applied current through it reaches zero. Once the SCR turns off, the voltage across the SCR rises sharply.

At time point 3, the turning off of SCR Q2 causes the synchronization signal on pin 5 of the microprocessor U2 to go low, which interrupts the microprocessor U2. In the preferred implementation of the first embodiment, microprocessor firmware is initialized to only respond to the falling edge of the interrupt, and is used to derive all phase control timing for an entire line cycle. As the UCD dimmer potentiometer R7 is rotated clockwise, the period of phase delay time between time point 3 and time point 4 of FIG. 5 is increased, causing the fluorescent light fixture being controlled by the UCD to dim. Conversely, counterclockwise rotation of the UCD dimmer potentiometer R7 decreases this phase delay time, thereby causing the fluorescent light fixture light output amount to intensify.

The inventors have found through experimentation that a typical fluorescent tube with magnetic ballast goes off (no light output by it) at approximately 120 degrees (about 5.5 mseconds) of phase delay. This is due to insufficient tube ionization caused by insufficient tube heater output. Without adequate tube ionization, the tube strike voltage exceeds that available from the AC line. The inventors have also found that they were not able to visibly discern a change in light output until the phase delay reached about 15 degrees (about 0.7 mseconds) of phase delay. The half-intensity point was about 90 degrees of phase delay (about 4.17 mseconds).

Microprocessor control of the phase delay controls the dim level of the fluorescent fixture (the load). In response to the falling edge of the synchronization interrupt, the microprocessor U2 resets a free-running internal hardware timer (not shown in the figures) to zero, then waits for the timer to reach the phase delay value corresponding to the current position of the UCD dimmer potentiometer R7. In a preferred implementation, the UCD dimmer potentiometer R7 is coupled to a rotatable dial that is disposed on a wall of a building, whereby, when a user rotates the dial, the resistance of potentiometer R7 changes accordingly. The change in the resistance of potentiometer R7 is discerned by the microprocessor U2, which then computes a different phase delay value for a next AC voltage waveform cycle based on the new dimmer setting.

After the calculated phase delay time corresponding to time point 4 is reached, the microprocessor U2 triggers the SCR Q1 on by bringing pin 2 of the microprocessor U2 low for a short period of time. In the preferred construction, an opto-isolated triac U1 is used to trigger the SCR on while isolating the microprocessor U2 from possible damaging transients. Once the SCR Q1 is triggered on and current begins to flow, SCR Q1 will latch itself on until current reaches zero during the next half cycle. Current flow through the load continues whenever the SCR Q1 or the SCR Q2 is triggered on. When the SCR triggers on, the synchronization signal 530 goes high again. The rising edge of the synchronization signal 530 is ignored by the microprocessor U2, which only reacts to a falling edge of the synchronization signal 530 (due to microprocessor firmware that allows interrupts only on the falling edge of a signal provided to its interrupt port).

Time point 5 corresponds to the next zero crossing of the load current waveform 520. At this point, the SCR Q1 turns off. Unlike the occurrence at time point 2, no synchronization signal occurs at time point 5. This is because the microprocessor 5V supply voltage (input line voltage) 340 is negative (it is a floating supply), and the open fluorescent circuit (that is, the load) is roughly ground. The synchronization signal 530 actually rises slightly (few tenths of a volt) after time point 5, because the "grounded" fluorescent circuit is actually higher in voltage than the microprocessor negative 5V power supply 340. Microprocessor firmware is provided such that no microprocessor interrupt is generated from this slight perturbation of the synchronization signal 530 (and also since it does not correspond to a voltage drop but rather a voltage rise).

Phase control for the latter half-cycle of the AC line voltage waveform 510 is derived from the previous earlier half-cycle interrupt. The microprocessor U2 measures the applied line frequency and computes the number of internal free-running hardware timer counts that it has to wait for before triggering the SCR on for this latter half-cycle. The timer counts for a time period corresponding between the time between time point 5 and time point 6.

At time point 6, the SCR Q2 is triggered on. At time point 6, the voltage of the synchronization signal 530 drops slightly (a few tenths of a volt). No microprocessor interrupt is generated here either, due to the microprocessor firmware being configured to not cause an interrupt for such a small voltage drop. Again, the SCR Q2 remains on during the negative half cycle, until the circuit current reaches zero.

At time point 7, the rising load current waveform 520 again reaches zero. Again the synchronization signal 530 goes to zero, which causes a microprocessor interrupt (since it is a falling edge of the synchronization signal 530). This also causes a resynchronization of an internal free-running timer of the microprocessor U2, and results in another phase delay cycle similar to the one that was described above with respect to the time point 2 and time point 3.

The UCD hardware design according to a preferred configuration of the first embodiment includes the components illustrated in the FIG. 4 schematic diagram. A brief description of each hardware component, and its applied function, is provided below.

The microprocessor U2 (which corresponds to microprocessor 350 of FIG. 3) provides the control functions and algorithms for the UCD according to the first embodiment based on an internally stored firmware program. By way of example and not by way of limitation, in a preferred implementation, a MICROCHIP™ 12C672 eight bit microprocessor incorporates 2 kilobytes programmable read only memory (PROM) for program storage, 128 bytes random access memory (RAM), an eight bit timer, 4 channel 8 bit Analog to Digital (A/D) converter, 4 MHz oscillator, and reset circuit in a very space efficient 8 pin package. More details on this microprocessor can be found at the Internet web site www.microchip.com. Of course, one of ordinary skill in the art will understand that other types and sizes of microprocessors may be utilized for the microprocessor to used in the first embodiment, while remaining within the scope of the invention.

Since the functionality of the microprocessor U2 exists internally, in a preferred implementation, six I/O pins may be allocated to either digital inputs and outputs or analog inputs. Two pins are reserved for +5 volt power and ground. By way of example and not by way of limitation, an Analog to Digital input impedance is approximately 10K ohms.

By way of example and not by way of limitation, the "push" on/off potentiometer switch SW1 is rated for the 6.3 ampere maximum dimming capacity. When turned off, the dimmer/load is entirely open circuited, resulting in no current flow to the load. Rotating potentiometer R7 and switch SW1 are preferably integrated into a single unit. Pushing the adjustment shaft of potentiometer R7 will cycle switch SW1 on and off. Potentiometer R7 is wired as an adjustable voltage divider, whereby rotating the shaft of potentiometer R7 adjusts the voltage at pin 7 of microprocessor U2. The microprocessor U2 reads the voltage at its pin 7 once every AC line cycle, and uses this voltage to derive the amount of phase delay (dim level) for the load. Resistor R8 is wired between the potentiometer wiper and ground, and is used to provide a more linear relationship between the potentiometer position and resulting dim level. By way of example and not by way of limitation, resistor R8 has a resistance of 4.7 kohms.

In the preferred implementation of the UCD according to the first embodiment, two SCRs Q1, Q2 are connected back to back to provide an active switching element for the UCD, and correspond to the solid state switch 320 of FIG. 3. The inventors found that TRIAC devices do not trigger as accurately as back-to-back SCRs when switching a highly inductive resistive load. Consistent and accurate switching element turn-OFF at the current zero crossing is very important to line synchronization. The use of a TRIAC as the active element may result in occasional flickering, which may be due to an unstable holding current level. As a result, the inventors found that an active element that includes back-to-back SCRs functions much better than one having a TRIAC in the energy savings device according to the invention, whereby using two SCRs provides an increase in switching current capability and better heat distribution to a heat sink.

By way of example and not by way of limitation, the SCRs utilized in a preferred implementation of the first embodiment are 600V, 15 ampere devices. The SCRs Q1, Q2 are designed to run very cool at maximum specified loads. The choice of which type of SCRs to use in the first embodiment may also be made based on a low holding current parameter for the SCRs. When a signal of either polarity triggers the opto-isolated triac U1, positive pulses from pin 4 and from pin 6 of the opto-isolated triac U1 are transmitted to gates (G) of the SCRs Q1, Q2, respectively. Opto-isolated triac U1 of FIG. 4 corresponds to solid state driver unit 330 shown in FIG. 3.

SCRs conduct current in one direction (from anode to cathode), with back-to-back SCRs having the capability to conduct in both directions. SCRs are latching devices, meaning that once they are trigger on, they will continue conducting until the anode-to-cathode current through them reaches zero (or reverses direction). An SCR is triggered on by pulling current out of its Gate pin, or bringing the Gate voltage a few volts lower than its anode pin. The holding current specification for an SCR specifies the minimum SCR current necessary for the SCR to latch on, and to remain latched on. A holding current on the order to 20 milliamperes is needed for proper operation of a typical SCR. Once the SCR current drops below the specified holding current, it will turn off until retriggered again. Only the SCR with its anode voltage positive relative to its cathode voltage is capable of being triggered on. This means that SCR Q1 controls the load during the positive half of the AC voltage waveform cycle, and SCR Q2 controls the load during the negative half of the AC voltage waveform cycle.

As shown best in FIG. 4, the opto-isolated triac U1 is used to trigger the SCRs Q1, Q2. The microprocessor U2 triggers opto-isolated triac's U1 internal triac, and subsequently one or the other SCR Q1, Q2, by illuminating the opto-isolated triac's U1 internal light emitting diode (LED). LED illumination occurs when the microprocessor U2 pulls its output pin 2 low, resulting in LED forward current. The opto-isolated triac U1 is capable of conducting current in either direction, depending on the relative voltages of pins 4 and pin 6 of the opto-isolated triac U1. For example, if pin 6 is higher than pin 4 of the opto-isolated triac U1, current will flow from pin 6 to pin 4. Connecting the opto-isolated triac U1 between the gates of the two SCRs Q1, Q2 provides a convenient method of triggering back-to-back SCRs.

Current flows into pin 6 of the opto-isolated triac U1 and out pin 4 in response to the positive half of the AC sine wave voltage waveform 510 (see FIG. 5) and vice versa in response to the negative half of the AC sine wave voltage waveform 510. Pulling current out of the associated SCR gate turns the device on. The internal structure of the SCR allows current to flow into the gate of the opposite device without triggering the device. Therefore, SCR Q1 will remain latched through the positive half of the sine wave current, whereupon at approximately zero crossing, the latching current will be insufficient and SCR Q1 will switch off. Similarly, the gate of SCR Q2 will source current into pin 4 of the triac U1 and out pin 6 of the triac U1 during negative half of the AC cycle, and remains latched again until approximately zero crossing. This switching sequence repeats for each cycle of the AC sine wave voltage waveform 510, providing full power of sine wave current to the (fluorescent) load. Accurate and stable triggering of the SCRs Q1 and Q2 are very important to the suppression of flickering.

Back-to-back SCRs are used to form an active element of an energy savings device according to a preferred implementation of the first embodiment since they were found by the inventors to be somewhat more stable in their turn OFF characteristics than a TRIAC. In order for an SCR to latch on, the anode/cathode current must exceed the latching current requirement. Once it is latched on, an SCR will remain on until it is turned off when anode/cathode current drops below holding current requirement. With such features, SCRs are ideal devices to be utilized for the active element that corresponds to the solid state switch 320 (see FIG. 3) of the UCD according to the first embodiment. One of ordinary skill in the art will recognize that other types of solid state switches may be utilized, as well as switch drivers, beyond the ones described herein, while remaining within the scope of the invention.

In the preferred implementation of the first embodiment, the opto-isolated triac U1 is utilized to provide driving signals to the SCRs Q1, Q2. By way of example and not by way of limitation, the opto-isolated triac U1 may be a MOC3022 opto-isolated triac, which drives the Q1 and Q2 gates and provides line transient protection to the microprocessor U2. A LED drive current of approximately 5 milliamps (via resistor R6, which is a 620 ohm resistor in the preferred implementation) is sufficient to reliably trigger the opto-isolated triac U1. The GP5 pin of microprocessor U2, which corresponds to pin 2 of the microprocessor U2, is configured for output and is capable of sinking up to 20 milliamps.

Referring to FIG. 5, the opto-isolated triac U1 outputs a drive signal starting at time point 6, whereby the drive signal is turned off well before the load current zero crossing at time point 7. Also, the opto-isolated triac U1 outputs a drive signal starting at time point 4, whereby the drive signal is turned off well before the load current zero crossing at time point 5.

Referring to FIG. 4, resistor R2 is a current limiting resistor, and is provided so as to limit the series current of the opto-isolated triac U1 to be less than one ampere under all circumstances. For 277 VAC installations, the value of resistor R2 should preferably be increased to 470 ohms due to the increase in the AC waveform voltage level.

In a preferred implementation of the first embodiment, the SCR trigger signal output by the optoisolated triac U1 stays on for approximately 1.2 milliseconds. The actual SCR trigger signal on time is not critical, since an SCR triggers on within a few microseconds of receiving a trigger signal to its gate. In a preferred implementation, and as explained above, the SCR trigger signal turns off before the next zero crossing of the load current waveform, in order to enforce some SCR off time (e.g., 0.25 milliseconds). This off time is provided in order to recharge the 5 volt power supply 340 (see FIG. 3) for the next cycle.

Resistor R1, capacitors C1, C2, diodes D1 and D2, and the 5 volt power supply of FIG. 4 are all utilized for a power supply control for the UCD according to the first embodiment, and together form the power supply unit 340 shown in FIG. 3. In a preferred implementation, the 5 Volt power supply 340 provides up to 20 millamps of power to the microprocessor U2, opto-isolated triac U1, and the potentiometer R7 at all times in which the UCD is powered. The 5 Volt power supply 340 floats with the AC line input. Voltage is derived by the widely varying voltage across SCRs Q1 and Q2. Power is available to the circuit only when SCRs Q1 and Q2 are switched OFF. When SCRs Q1 and Q2 are turned on, the 5 Volt supply 340 is maintained by capacitor C1 and is stabilized by zener diode D1. Silicon Diode D2 provides a discharge path for capacitor C1. Resistor R1 and capacitor C2 provide an AC coupled voltage drop to limit silicon diode D1 and zener diode D2 current and dissipation. By way of example and not by way of limitation, the microprocessor U2 remains entirely functional with any supply voltage over 3.3 Volts at a current of 3 milliamps. In a preferred implementation of the first embodiment, supply regulation is not critical as long as the supply voltage maintains the 3.3V minimum.

Resistors R3, R2, R4, R5, and diode D3 of FIG. 4 are elements making up the Line sync unit 360 shown in FIG. 3. The falling half of the AC line output (when SCRs Q1 and Q2 turn off) is used for line synchronization. SCRs Q1 and Q2 turn off at the line current zero crossing. Zener diode D3 protects the microprocessor interrupt input (port 5 of the microprocessor U2) against unforeseen line and switching transient spikes. Resistor R5 limits current input to the microprocessor U2 and allows the internal microprocessor protection or clamp diodes to function while preventing any possible burnout. Resistors R2, R3 and R4 also provide a current limiting and line synchronization function for the UCD.

The inventors have realized that stable AC line synchronization is very important to non-flickering operation when controlling inductive and/or resistive loads (especially conventional Magnetic Ballast Fluorescent Fixtures). These synchronization methods are implemented in the firmware of the microprocessor U2 according to the first embodiment, and are applicable to the other embodiments as well.

The microprocessor firmware provides a Line Sync Edge Detection function. In detail, the microprocessor U2 is interrupted on the falling edge of Line Syncronization signal 530 (see FIG. 5) which occurs once every AC cycle as the switching element turns off at the current zero crossing. SCRs have a characteristic in that they latch themselves on until the current through them reaches zero. The point where they turn off is used as the line synchronization. An internal timer of microprocessor U2 is initialized at this interrupt, and timing parameters for the next entire AC cycle calculated in firmware. Using a single current zero crossing per AC cycle cancels any non-uniformity of the positive and negative halves of the current waveform, as well as eliminates interrupt input threshold hysteresis effects.

The firmware of microprocessor U2 also provides an AC Line Period Determination function. In detail, at initial power up, the microprocessor performs a timing analysis of the AC line with the load switched off so that specific timer counts for each half phase may be calculated. Leaving the load off during this period provides a very accurate measurement of the AC line voltage, without inductive load phase shift influence. At the first interrupt after initial power up, the microprocessor timer is initialized to zero. At the next interrupt the timer value is stored, representing the number of timer counts for a full AC cycle. Subsequent phase timing parameters are derived from this number. Intra-interrupt timing functions are driven by waiting for specific timer counts.

The microprocessor firmware also performs a Phase Timing Calculation function. In detail, once the line period has been determined, the firmware of microprocessor U2 performs phase timing calculations. Since synchronization is performed only once per AC cycle, a determination of the cycle half time is made by dividing the period by two (shift right one time). Next, a calculation of when the cycle is completed (cyclendtime) in anticipation of the next interrupt is made.

The firmware of microprocessor U2 further performs a Dead Time Implementation function. In detail, circuit power is only available when the series switching elements (SCRs) are turned off, therefore microprocessor firmware guarantees a minimum off time (deadtime) for each AC line half cycle to restore the 5 volt supply.

The firmware of microprocessor U2 also performs a Fixture Warmup function. In detail, fluorescent tubes should be fully warmed up before they can be reliably dimmed. This feature may not be desirable for other types of inductive or resistive loads, and may be easily deleted from the control device, without departing from the scope of the invention. To address this requirement, the fixture is set to full intensity for a first time period after initial power up. By way of example and not by way of limitation, the first time period is set to 12 seconds. Upon completion of the 12 second period, the intensity is returned to the dim level corresponding to the position of potentiometer R7 (see FIG. 4).

The firmware of microprocessor U2 further provides a Sync Window Implementation function. In detail, in order to reject spurious line transients which could possibly upset dimmer timing, a sync window algorithm is utilized in the first embodiment. At the end of each full AC cycle, the microprocessor U2 waits until cyclendtime which occurs a few timer counts before the next line interrupt, before re-enabling interrupts. If a spurious interrupt occurred between the last sync edge and cyclendtime, it is effectively ignored.

The firmware of microprocessor U2 also provides a Slow Phase Timing (Dim Level) Changes function. In detail, when using a current zero crossing sync with an inductive magnetic ballast, any phase timing (dim level) change causes a slight synchronization variance which could cause instability (flickering) if not greatly damped out. To greatly lessen this possibility, phase timing changes are limited to one timer count per AC cycle, thereby minimizing this effect.

The firmware of microprocessor U2 further provides a function for pulsing the SCRs ON at the correct time. In detail, the SCRs Q1, Q2 are pulsed on, instead of just turned on and left on at the proper time, to reduce the drain on the 5 Volt power supply 340 (see FIG. 3).

More details of the microprocessor firmware implementation according to a preferred implementation of the first embodiment is provided in detail below. In the preferred implementation, the firmware of microprocessor U2 is written using a Microchip assembler language specific to the 12C672 eight bit microprocessor. Of course, based on the type of microprocessor utilized in the first embodiment, the choice of software language used to write the microprocessor firmware will be utilized accordingly.

A detailed flow chart of the preferred implementation of microprocessor firmware to be utilized by a microprocessor U2 according to the first embodiment of the UCD is illustrated in FIG. 6. Major flow chart function descriptions are provided below.

For UCD implementation, a Reset occurs only during initial power up. At this time, microprocessor memory and register contents are random, and are thereby initialized before they can be used. In the preferred implementation of the first embodiment, the microprocessor U2 has an internal reset circuit which recognizes when power is initially applied. Upon Reset, the microprocessor U2 begins execution at address 0000, which is where the initialization firmware starts. Once this initialization executes, it is not re-executed unless another power up sequence occurs.

Two interrupts are enabled for the UCD according to the first embodiment. First, the external synchronization falling edge interrupt, from which all phase delay calculations are derived, is enabled. Second, the internal hardware free-running timer overflow interrupt is enabled. In the preferred implementation of the first embodiment, the timer is an 8 bit timer which is incremented once every 64 microseconds. The timer overflows every 16.384 milliseconds (256 counts), which is slightly less than a full 16.667 millisecond line cycle. During an interrupt, the microprocessor U2 stops executing where it is, saves it's state (e.g., processor status word and program counter), and executes interrupt code. Initial line parameter calculations, hardware timer maintenance, and Analog to Digital Converter (ADC) maintenance occurs during the interrupt firmware.

Referring to FIG. 6, "Main" is the start of the primary UCD software program run by the microprocessor U2. It is entered after initial power up initialization and once per complete line cycle. "Main" keeps track of the current line half cycle, and performs all phase timing calculations based on the free-running hardware timer. Phase timing is implemented by waiting for the appropriate free-running timer count to occur, then calling the TrigScr subroutine which implements the CR trigger timing. Specific free-running timer values to wait for are calculated based on the following factors:

a) Dimpot position: As indicated by the converted ADC value. Rotating the dimpot potentiometer clockwise will reduce phase delay, and increase florescent intensity.

b) FullOnMode: During the first 12 seconds after initial power up, the UCD is in FullOnMode. During this time, the florescent load is forced into full intensity to warm the tubes. During FullOnMode, phase delay is fixed at the constant value fulltime. When not in FullOnMode, phase delay is calculated based on dimpot position, and results of the softdim calculation. The softdim calculation prevents large cycle to cycle phase delays from occurring. This provides a stabilizing effect on florescent intensity.

c) Cycle Half: After completion of the first half of the line cycle, firmware waits for the pre-calculated half period free-running hardware timer value, resets the timer, and jumps back to Main. This causes the second half cycle phase delay timing to be identical to the first half cycle. At the end of the second half cycle, firmware will wait for the free-running hardware timer to reach the pre-calculated cyclendtime, then re-enable interrupts in anticipation of the next full line cycle.

After the appropriate phase delay has be determined, a call to TrigScr is executed whereby the SCRs Q1, Q2 are turned on at the appropriate times.

The TrigSCR sub-routine toggles the SCRs Q1, Q2 on and off for a period of time to minimize drain on the 5V power supply. Once the SCR current is greater than the SCR specified holding current, it will latch on for the duration of the half cycle, until the current reaches zero again. Relative free-running hardware timer values are used to accomplish this pulse ON, pulse OFF, and pulse duration timing.

The following are descriptions of each section of the dimmer firmware utilized by the microprocessor U2 according to a preferred implementation of the first embodiment, whereby each section is identified by line number, then label and references to the flow chart of FIG. 6. Of course, other firmware may be utilized as would be recognized by one of ordinary skill in the art, while remaining with the scope of the invention.

---

Line 1: Defines the microprocessor as the target for the assembler

Line 2: This include file defines the microprocessor register names and memory mapped register addresses.

Line 5: A list of defined memory mapped addresses follows:

| | |
|---|---|
| dimpot: | Storage of the dim potentiometer analog value |
| timerstat: | Mode Flags specific to dimming mode |
| tmrovflcntr: | Used as an overflow counter to the internal 8 bit counter TMR0 |
| intovflcntr; | LSB of counter used for 12 sec full ON |
| fullintcntr: | MSB of counter used for 12 sec full ON |
| timereg: | Temp Storage of TMR0 Count |
| periodmsb: | Measured MSB of Full wave TMR0 Count |
| periodlsb: | Measured LSB of Full wave TMR0 Count |
| halftime: | Calculated TMR0 Count for Half Wave |
| trigtime: | Calculated TMR0 Count to Trigger SCR |
| SCRofftime: | Temp Storage where time to turn off SCR is stored each cycle |
| SCRlstime: | Temp Storage for Last SCR time . . . subsequent SCR ON/OFF functions key off of this stored TMR0 value |
| cycendtime: | Re-Enable Edge Interrupt time |
| softlast: | Temp Storage of last dim time count is stored. Used for Soft Dim |

Line 23 ;GPIO Bit Defs

| | |
|---|---|
| potanal | 12C672 GPIO Pin Allocated to Potentiometer Analog Input |
| gp1 | 12C672 GPIO Pin Not Used |
| acint | 12C672 GPIO Pin Allocated for AC Interrupt Input |
| gp3 | 12C672 GPIO Pin Not Used |
| gp4 | 12C672 GPIO Pin Not Used |
| SCRdrv | 12C672 GPIO Pin GPIO SCR Drive Output |

Line 31 ;TimerStat Bit Defs

| | |
|---|---|
| firstedg | Flag: First Interrupt Edge Occured |
| secedge | Flag: Second Interrupt Edge Occured |
| fullonmode | Flag: Full on mode |
| newedge | Flag: New Edge Flag |
| cycsechalf | Flag: Second Half of Period |
| oddedge | Not Used in this Version |

Line 39 ;Value Defs

| | |
|---|---|
| intovflow = d'3' | ;FullOnMode Int Overflows ~4 Secs per inc |
| dimofst = h'4' | ;ADC Offset, Higher Numbers go Dimmer |

-continued

```
maxofst = h'7f'          ;Maxdim Offset
maxdima = h'fe'          ;Maxdim Level
maxdimlvl = h'd0'        ;Maxdim
intwindow = d'3'         ;Interrupt Window
SCRpulsetime = h'37'     ;Time SCR is Pulsed ON and Off
deadtime = d'8'          ;Dead time past zero crossing
fulltime = d'8'          ;Full On time past zero crossing
```

Line 54 rstvec The microprocessor starts execution at address 0 after Reset, Interrupts are disabled, then memory initialized Line 58 intvec The microprocessor interrupt vector for enabled interrupts is at address 4

Line 59 intsvc TMR0 is cleared at each falling edge of the AC interrupt. After a Reset, a wait for the zeroth edge is executed. Upon occurrence of the zeroth edge, TMR0 overflow interrupt is enabled so that the AC edge to edge period can be calculated. Upon occurrence of the first edge interrupt, AC parameters are calculated and used in subsequent phase calculations.

Line 61 Jump table based on edge occurrences

Line 65 notfirst Zeroth edge interrupt has occurred, enable TMR0 overflow Interrupts Line 72 firsthap First interrupt has happened, count number of TMR0 overflows, enable Next TMR0 overflow interrupt Line 78 notmrint If it's a second edge interrupt, then disable subsequent TMR0 overflow Interrupts, and then calculate AC timing parameters Line 81 caltime AC parameters such as period, halftime, and cyclendtime, are calculated once. Flag secedge is then set, and further edge interrupts enabled. From now on, each edge interrupt constitutes an AC line synchronization signal used for phase control of the SCRs Line 100 sechap Once the second edge interrupt has occurred, then 12 seconds of full on is executed to fully warm the tube heaters. Fullintcntr, and intovflcntr form a 16 bit counter which count 16.667 mS edge interrupts. A total of 768 edge interrupts provides a net 12.8 seconds of fluorescent tube full on time.

Line 112 fulldun Upon conclusion of the full on mode, the fullonmode flag is cleared in timerstat.

Line 113 notfull Each edge interrupt, the A/D converter is checked for conversion complete. If it has completed the dimpot value is inverted by exclusive Oring the input value and stored in the memory location dimpot.

Line 121 nocvrt A/D conversion has completed, another conversion is started. The newedge flag is set and the cycsechalf flag cleared, indicating to the main program code that an interrupt had occurred, and that it is now the first half of the AC cycle.

Line 123 glitint TMR0 is cleared, Edge interrupts are re-enabled, and a return from interrupt executed Line 129 initmem Microprocessor hardware registers are initialized, program defined registers are cleared, and finally edge interrupts are enabled.

Line 173 main Main part of the program. Wait for second edge interrupt. At this time, all AC line parameters have been calculated, and normal phase control can commence.

Line 175 main1 Wait for each new edge. Newedge is a handshake flag with intsvc which is used to wait for a new edge at the completion of each AC cycle.

Line 178 main2 Entered at the start of each AC cycle. Potentiometer scaling to actual TMR0 counts are performed once per AC cycle. Edge Interrupts are disabled, dimpot contains the commanded dim value. The memory location softlast is used to calculate the desired dim value time.

Line 189 sechalf This is the entry point for the second half of the AC cycle. If NOT in Fullonmode, then go to dimtrig. Else, it is fullonmode at sechala.

Line 191 secala A wait until TMR0 = deadtime is executed. Deadtime defines the earliest time (in TMR0 counts) the SCR may be triggered ON after an AC line voltage zero crossing. A call to trigSCR turns the SCR on for a period of time. After returning, the first cycle half is complete.

Line 198 dimtrig Fullonmode has completed, enforce minimum deadtime limit, by waiting for TMR0 to reach deadtime value.

Line 202 dimwait Past deadtime, now wait for the calculated TMR0 value corresponding to the calculated phase delay for the indicated dim level. The memory location trigtime is -continued

| | | |
|---|---|---|
| | | incremented or decremented once each time, effectively "chasing" the desired dim level stored in softlast. |
| Line 217 | hafcycl | Halfcycle parameters are checked. If already in the second half, a wait for next edge interrupt (jump to rstcycle) is executed. If Not already in second half, a wait until the previously calculated Halftime TMR0 value is executed. Once past halftime, TMR0 is cleared, and the cycsechalf flag is set. Then a jump to sechalf occurs, duplicating timing parameters for the second half of the AC cycle. |
| Line 229 | rstcycle | Once timing for the second half of the AC cycle has been executed, a wait until cyclendtime is executed before edge interrupts are Re-enabled. This provides a window which rejects AC line transients which occur outside of the window. Upon passage of the window, Interrupts are re-enabled, and a jump to main1 is executed, causing a Wait for the next edge interrupt. |
| Line 240 | trigSCR | TrigSCR is a routine that is called when it's time to turn on the SCR. When called, the SCR is triggered on (SCRdrv is brought low), then the SCRofftime is calculated based on addition of the constant SCRpulsetime, and the current TMR0 value. A wait until SCRofftime is executed, whereupon the SCR is turned off (SCRdrv is brought high). If cycendtime occurs during the time trigSCR executes, drive to the SCR is deasserted, and a return to the calling code is executed. |
| Line 265 | end | End of the program. |

FIG. 7 shows a block diagram of an energy savings device UCD-2 according to a second embodiment, and FIG. 8 shows a schematic circuit diagram of the energy savings device UCD-2 according to the second embodiment. The energy savings device UCD-2 according to the second embodiment provides all of the functions of the first embodiment, along with extra functions. The UCD-2 includes an occupancy sensor, an ambient light sensor, and an AC line modem for remote communications to a central energy management system, for example. The UCD-2 provides a more robust energy savings function than the UCD according to the first embodiment.

As shown in FIG. 7, an ambient light sensor unit 710 of the second embodiment provides the capability to adjust the dimming level for constant level illumination during day/night ambient illumination variances. Referring also to FIG. 8, the ambient light sensor unit 710 includes a photo-resistor R19 with amplifier 720, which provides a stable indication of the total ambient illumination via a signal AMBLITE provided to port 1 of the microprocessor U2. The microprocessor U2 adjusts the dimming level to maintain this total ambient illumination level. For example, during a cloudy day, if the clouds break during the afternoon and thus the light through windows of an office increases, this results in an increase in the illumination level picked up by the ambient light sensor unit 710. Accordingly, the microprocessor U2 will adjust the load current waveform to provide a slightly dimmer signal than what was previously provided (during the cloudy period), so as to maintain a stable ambient illumination for the office.

Referring to FIG. 7, the occupancy sensor unit 730 of the second embodiment provides the capability to sense movement within an illumination area. The occupancy sensor unit 730 is configured to provide a signal indicative of no movement to the microprocessor U2 if no movement is sensed after an extended interval of time (e.g., 15 minutes or more). Upon receipt of the "no movement" signal from the occupancy sensor unit 730, the microprocessor U2 turns the light fixture off, in order to save energy. Similarly, illumination to a preset level is restored if movement occurs, such as when a person walks into a room. Referring to FIG. 8, the occupancy sensor unit 730 according to a preferred implementation includes a passive infrared sensor 750 with a multifaceted (Fresnel) lens 740 in front of a pyroelectric transducer. For example, a Murata IRA-E710ST0 may be utilized as the motion detector for the occupancy sensor unit 730. The lens 740 focuses infrared energy from a multitude of narrow, discrete beams or cones. As a warm body moves across the field of view of the detector, the transducer output has peaks and valleys which are amplified, thereby providing an indication that movement is occurring. This results in a signal MOTDET that is indicative of movement being provided to the microprocessor U2.

Referring to FIG. 7, the AC line modem 760 of the second embodiment enables bi-directional communications with an energy management unit, such as with a centralized energy management system (EMS). In one implementation shown in FIG. 8, the AC line modem is implemented as a line modem TDA5051 component. The EMS has the capability to remotely control some or all dimming functions and modes including turn off illumination (via signal PWRDWN provided to microprocessor U2), set dimming level, and verify occupancy sensor status (possible burglar alarm function). The EMS is preferably a standard personal computer with external AC line modem connected to a serial port. Software running under an operating system, such as the Windows™ operating system, maintains the status of all units within a local area. The AC line modem 760 functions by modulating a 200 KHz signal onto the AC power line via a filter network 770 that includes an inductor L1 and a capacitor C4 (see FIG. 8), in one possible implementation of the second embodiment. The EMS can communicate with a wide area of dimming units that are on a common AC line step down transformer, for example. Each dimming unit carries a unique address to facilitate a multi-drop communications network via the power lines.

In a third embodiment, unlike the "loaded" second embodiment, only the ambient light sensor unit of the second embodiment is provided along with the features of the first embodiment.

In a fourth embodiment, only the occupancy sensor unit of the second embodiment is provided along with the features of the first embodiment.

In a fifth embodiment, only the AC line modem features of the second embodiment is provided along with the features of the first embodiment.

A sixth embodiment of the invention includes all of the features described above with respect to the second embodiment, as well as a remote control function. The remote control function allows a user to set a light level by a remote control unit, without having to go to a switch box on a wall. By pointing the remote control unit in a direction of the switch box, and by enabling a button on the remote control unit, a signal is picked up by an element (e.g., infrared sensor, IR sensor) on the switch box, similar to a television remote control unit, whereby a room light level is either increased or decreased depending on the user's selection on the remote control unit. The remote control function can also be used with any of the other embodiments described above.

A seventh embodiment of the invention is described herein with respect to FIGS. 9 and 10. The seventh embodiment is directed to a master/follower control system, whereby a master unit controls one or more reactive loads, and whereby at least one follower unit coupled to the master unit responds exactly the same as the master unit to control loads coupled to each follower unit. The master/follower control system according to the seventh embodiment provides for modular flexibility for different sizes of facilities. FIG. 9 shows a schematic circuit diagram of a master unit 900. FIG. 10 shows a schematic circuit diagram of a follower unit 1000 that is controlled by the master unit 900 of FIG. 9.

The seventh embodiment includes a conduction angle phase switching circuit connected in parallel with a reactive load, an AC power source for switching power across the load, and a line switching circuit for enabling the application of AC power to the load through the phase switching circuit.

In the seventh embodiment, an ambient light sensor 910 is provided for generating a light control signal indicative of the amount of ambient light present in a particular location. Coupled to the light sensing circuit is a phase angle conduction control circuit, which generates and applies to a control terminal of the phase switching circuit a phase control signal to control the phase angle conduction time of the phase switching circuit, based on the amount of ambient light measured by the light sensing circuit, in order to maintain a substantially constant lighting level. In FIG. 9, the microprocessor U3 functions as the phase angle conduction control circuit.

Integrated with the phase angle conduction control circuit is an RC filter circuit which gradually increases the phase angle conduction time switching circuit from zero, or from a predetermined minimum value, to a steady state phase angle conduction time based on the ambient light conditions sensed by the light sensing circuit, after power enabling by the line switching circuit.

Referring to FIG. 9, the master unit includes a line switch SW1 connected in series with an AC power source between a hot (black) and a neutral (white) power line. Connected in series between the hot and neutral power lines is an reactive load (e.g., fluorescent lamp), and a phase angle control switching device that includes SCRs Q1 and Q2 and an opto-isolated triac U1 for driving the SCRs (see discussion with respect to the first embodiment).

Also shown in FIG. 9 is the microprocessor U3, which receives a line sync signal from a bridge circuit D1 that is coupled to the hot and neutral lines. Based on the line sync signal, and based on the setting of the potentiometer and switch SW1, the microprocessor U3 provides control signals to the opto-isolated triac U1, as well as to follower units coupled to the master unit via pulse width modulated (PWM) signaling.

FIG. 10 shows the elements of a follower unit 1000, which receives the PWM control signals from the master unit, and which controls one or more loads connected to the follower unit based on on/off switching of its active element (SCRs Q1, Q2, and opto-isolated triac U1) via those control signals.

Different embodiments of the present invention have been described according to the present invention. Many modifications and variations may be made to the techniques and structures described and illustrated herein without departing from the spirit and scope of the invention. Accordingly, it should be understood that the apparatuses described herein are illustrative only and are not limiting upon the scope of the invention. With the use of an energy savings device according to an embodiment of the invention, it is possible to achieve a 50% or more energy savings, while not adversely affecting the perceived amount of light by users.

What is claimed is:

1. An energy savings device for an inductive or resistive load that is powered by an input AC voltage waveform, comprising:

a setting unit configured to allow a user to set a desired power operating level for the load;

a microprocessor configured to receive a signal from the setting unit indicative of the desired power operating level for the load, to determine a phase delay to be provided to an output AC voltage waveform that is to be provided to the load, and to output a control signal as a result thereof; and an active element provided between a line that provides the input AC voltage waveform and the load, the active element receiving the control signal and turning off and on at predetermined times in accordance with the control signal, so as to create the output AC voltage waveform from the input AC voltage waveforms, wherein the load is connected to a neutral line, and wherein the energy savings device is not connected to the neutral line and thereby operates as a two-wire device.

2. The energy savings device according to claim 1, wherein the active element comprises:

a first SCR having an anode terminal coupled to the line and having a cathode terminal coupled to the load; and a second SCR coupled in parallel to the first SCR, the second SCR having a cathode terminal coupled to the line and having an anode terminal coupled to the load.

3. The energy savings device according to claim 1, wherein the load is a fluorescent light fixture having a magnetic ballast.

4. The energy savings device according to claim 3, further comprising:

a motion detector configured to detect any motion within a particular area, and to provide a motion signal to the microprocessor indicative as to whether or not any motion is detected, wherein the microprocessor is configured to control a dimming level of the fluorescent light fixture based in part on the motion signal.

5. The energy savings device according to claim 1, further comprising a floating power supply for supplying power for the microprocessor and the active element.

6. The energy savings device according to claim 1, further comprising floating power supply means for supplying power for the signal conversion means and the processing means.

7. An energy savings device for an inductive or resistive load that is powered by an input AC voltage waveform, comprising:

a setting unit configured to allow a user to set a desired power operating level for the load;

a microprocessor configured to receive a signal from the setting unit indicative of the desired power operating level for the load, to determine a phase delay to be provided to an output AC voltage waveform that is to be provided to the load, and to output a control signal as a result thereof;

an active element provided between a line that provides the input AC voltage waveform and the load, the active element receiving the control signal and turning off and on at predetermined times in accordance with the control signal, so as to create the output AC voltage waveform from the input AC voltage waveform; and an opto-isolated triac provided between the microprocessor and the active element, the opto-isolated triac providing the control signal to the first and second SCRs while providing a protection function for the microprocessor, wherein the active element comprises:

a first SCR having an anode terminal coupled to the line and having a cathode terminal coupled to the load; and a second SCR coupled in parallel to the first SCR, the second SCR having a cathode terminal coupled to the line and having an anode terminal coupled to the load.

8. An energy savings method for an inductive or resistive load that is powered by an input AC voltage waveform, the method comprising:

setting a desired power operating level for the load;

receiving, by a microprocessor, a signal indicative of the desired power operating level for the load, and determining a phase delay to be provided to an output AC voltage waveform that is to be provided to the load, and to output a control signal as a result thereof; and receiving the control signal, and, in response thereto, turning an active element off and on at predetermined times in accordance with the control signal, so as to create the output AC voltage waveform from the input AC voltage waveform, wherein the active element is disposed between a line carrying the input AC voltage waveform and the loads, wherein the load is connected to a neutral line, and wherein the active element and the microprocessor are components of an energy savings device that is not connected to the neutral line and that therefore operates as a two-wire device.

9. The energy savings method according to claim 8, wherein the active element comprises:

a first SCR having an anode terminal coupled to the line and having a cathode terminal coupled to the load; and a second SCR coupled in parallel to the first SCR, the second SCR having a cathode terminal coupled to the line and having an anode terminal coupled to the load.

10. The energy savings method according to claim 8, wherein the load is a fluorescent light fixture with a magnetic ballast.

11. The energy savings method according to claim 10, further comprising:

detecting any motion within a particular area, and providing a motion signal to the microprocessor indicative as to whether or not any motion is detected; and controlling a dimming level of the fluorescent light fixture based in part on the motion signal.

12. A computer program product being executed by a microprocessor and which provides an energy savings capability for an inductive or resistive load that is powered by an input AC voltage waveform, the computer program product comprising:

first computer code configured to set a desired power operating level for the load;

second computer code configured to receive a setting signal output from the first computer code that is indicative of the desired power operating level for the load, the second computer code further configured to determine a phase delay to be provided to an output AC voltage waveform that is to be provided to the load, and to output a control signal as a result thereof; and third computer code configured to provide a control signal to an active element provided between a line that provides the input AC voltage waveform and the load, the active element receiving the control signal and turning off and on at predetermined times in accordance with the control signal, so as to create the output AC voltage waveform from the input AC voltage waveform, wherein the control signal is provided based on the phase delay determined by the second computer code and the setting signal output by the first computer code, wherein the load is connected to a neutral line, and wherein the microprocessor is a component of an energy savings device that is not connected to the neutral line and that thereby operates as a two-wire device.

13. The computer program product according to claim 12, wherein the active element comprises:

a first SCR having an anode terminal coupled to the line and having a cathode terminal coupled to the load; and a second SCR coupled in parallel to the first SCR, the second SCR having a cathode terminal coupled to the line and having an anode terminal coupled to the load.

14. The computer program product according to claim 12, further comprising:

fourth computer code configured to detect any motion within a particular area, and to provide a motion signal to the microprocessor indicative as to whether or not any motion is detected, wherein the microprocessor is configured to control a dimming level of the fluorescent light fixture based in part on the motion signal.

15. The computer program product according to claim 12, wherein the load is a fluorescent light fixture with a magnetic ballast.

16. A computer program product being executed by a microprocessor and which provides an energy savings capability for an inductive or resistive load that is powered by an input AC voltage waveform, the computer program product comprising:

first computer code configured to set a desired power operating level for the load;

second computer code configured to receive a setting signal output from the first computer code that is indicative of the desired power operating level for the load, the second computer code further configured to determine a phase delay to be provided to an output AC voltage waveform that is to be provided to the load, and to output a control signal as a result thereof;

third computer code configured to provide a control signal to an active element provided between a line that provides the input AC voltage waveform and the load, the active element receiving the control signal and turning off and on at predetermined times in accordance with the control signal, so as to create the output AC voltage waveform from the input AC voltage waveform; and an opto-isolated triac provided between the microprocessor and the active element, the opto-isolated triac providing the control signal to the first and second SCRs while providing a protection function for a microprocessor which executes the first, second, and third computer codes, wherein the control signal is provided based on the phase delay determined by the second computer code and the setting signal output by the first computer code, wherein the active element comprises:

a first SCR having an anode terminal coupled to the line and having a cathode terminal coupled to the load; and a second SCR coupled in parallel to the first SCR, the second SCR having a cathode terminal coupled to the line and having an anode terminal coupled to the load.

17. An energy savings device for an inductive or resistive load that is powered by an input AC voltage waveform, comprising:

setting means for allowing a user to set a desired power operating level for the load;

processing means for receiving a signal from the setting unit indicative of the desired power operating level for the load, and for determining a phase delay to be provided to an output AC voltage waveform that is to be provided to the load, and to output a control signal as a result thereof; and signal conversion means, provided between a line that provides the input AC voltage waveform and the load, for receiving the control signal and turning off and on at predetermined times in accordance with the control signal, so as to create the output AC voltage waveform from the input AC voltage waveform, wherein the load is connected to a neutral line, and wherein the energy savings device is not connected to the neutral line and thereby operates as a two-wire device.

18. The energy savings device according to claim 17, wherein the signal conversion means comprises:

a first SCR having an anode terminal coupled to the line and having a cathode terminal coupled to the load; and a second SCR coupled in parallel to the first SCR, the second SCR having a cathode terminal coupled to the line and having an anode terminal coupled to the load.

19. The energy savings device according to claim 17, wherein the load is a fluorescent light fixture having a magnetic ballast.

20. The energy savings device according to claim 19, further comprising:

motion detection means for detecting any motion within a particular area, and to provide a motion signal to the processing means indicative as to whether or not any motion is detected, wherein the processing means controls a dimming level of the fluorescent light fixture based in part on the motion signal.

21. The energy savings device according to claim 17, wherein the setting means comprises a rotatable knob provided on a wall.

22. An energy savings device for an inductive or resistive load that is powered by an input AC voltage waveform, comprising:

setting means for allowing a user to set a desired power operating level for the load;

processing means for receiving a signal from the setting unit indicative of the desired power operating level for the load, and for determining a phase delay to be provided to an output AC voltage waveform that is to be provided to the load, and to output a control signal as a result thereof;

signal conversion means, provided between a line that provides the input AC voltage waveform and the load, for receiving the control signal and turning off and on at predetermined times in accordance with the control signal, so as to create the output AC voltage waveform from the input AC voltage waveform; and isolation means provided between the processing means and the conversion means, the isolation means providing the control signal to the first and second SCRs while providing a protection function for the processing means, wherein the signal conversion means comprises:

a first SCR having an anode terminal coupled to the line and having a cathode terminal coupled to the load; and a second SCR coupled in parallel to the first SCR, the second SCR having a cathode terminal coupled to the line and having an anode terminal coupled to the load.

* * * * *